US010563566B2

(12) United States Patent
Brinkmann et al.

(10) Patent No.: US 10,563,566 B2
(45) Date of Patent: Feb. 18, 2020

(54) METHOD FOR OPERATING A COMBUSTION ENGINE HAVING A SPLIT COOLING SYSTEM AND CYLINDER SHUTDOWN

(71) Applicant: Ford Global Technologies, LLC, Dearborn, MI (US)

(72) Inventors: Franz J. Brinkmann, Huerth-Efferen (DE); Vanco Smiljanovski, Bedburg (DE); Joerg Kemmerling, Monschau (DE); Hans Guenter Quix, Herzogenrath (DE); Volker Haupts, Aachen (DE); Helmut Matthias Kindl, Aachen (DE); Werner Willems, Aachen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 654 days.

(21) Appl. No.: 15/006,999

(22) Filed: Jan. 26, 2016

(65) Prior Publication Data

US 2016/0215681 A1 Jul. 28, 2016

(30) Foreign Application Priority Data

Jan. 26, 2015 (DE) ..... 10 2015 201 238

(51) Int. Cl.
*F02B 75/18* (2006.01)
*F01P 7/16* (2006.01)
(Continued)

(52) U.S. Cl.
CPC ..... *F01P 7/165* (2013.01); *F01P 3/02* (2013.01); *F02D 41/0087* (2013.01); *F01P 2003/027* (2013.01)

(58) Field of Classification Search
CPC ..... F01P 7/165; F01P 3/02; F01P 2003/027; F01P 7/167; F02D 41/0087; F02D 13/06; F02D 41/0082; F02D 41/064
(Continued)

(56) References Cited

U.S. PATENT DOCUMENTS 4,381,736 A * 5/1983 Hirayama ..... F01P 7/164 123/41.1
5,080,049 A * 1/1992 Solomon ..... F01P 3/02 123/41.78
(Continued)

FOREIGN PATENT DOCUMENTS

CN 101333969 A 12/2008
CN 103573373 A 2/2014
(Continued)

OTHER PUBLICATIONS

State Intellectual Property Office of the People's Republic of China, Office Action and Search Report Issued in Application No. 201610052641.0, dated Feb. 22, 2019, 12 pages. (Submitted with Partial Translation).

*Primary Examiner* — Long T Tran
*Assistant Examiner* — James J Kim
(74) *Attorney, Agent, or Firm* — Geoffrey Brumbaugh; McCoy Russell LLP

(57) ABSTRACT

Methods and systems are provided for a coolant system. In one example, a method may include flowing coolant to an active cylinder during a cold-start.

20 Claims, 4 Drawing Sheets

(51) Int. Cl.
*F01P 3/02* (2006.01)
*F02D 41/00* (2006.01)

(58) Field of Classification Search
USPC ..... 123/41.74
See application file for complete search history.

(56) References Cited

U.S. PATENT DOCUMENTS

| | | | | |
|---|---|---|---|---|
| 6,223,702 | B1 * | 5/2001 | Achenbach | F02F 1/10 123/41.71 |
| 7,721,683 | B2 * | 5/2010 | Lutz | F01P 3/02 123/41.1 |
| 7,966,978 | B2 | 6/2011 | Maehara et al. | |
| 8,327,619 | B2 * | 12/2012 | Persson | F02D 17/02 60/285 |
| 10,240,511 | B2 * | 3/2019 | Clark | F01P 3/02 |
| 2007/0295289 | A1 * | 12/2007 | Hayashi | F01P 3/02 123/41.21 |
| 2009/0000576 | A1 * | 1/2009 | Maehara | F02D 13/06 123/41.02 |
| 2010/0251977 | A1 | 10/2010 | Warchuck | |
| 2011/0098883 | A1 * | 4/2011 | Eser | F01P 5/14 701/33.4 |
| 2011/0296834 | A1 * | 12/2011 | Kuhlbach | F01P 7/165 60/605.3 |
| 2013/0160723 | A1 * | 6/2013 | Miyagawa | F01P 7/16 123/41.1 |
| 2016/0137030 | A1 * | 5/2016 | Leone | F01P 7/165 237/5 |
| 2016/0186641 | A1 * | 6/2016 | Ogino | F01P 3/02 123/41.74 |
| 2016/0230639 | A1 * | 8/2016 | Biller | F02F 1/10 |

FOREIGN PATENT DOCUMENTS

| | | | |
|---|---|---|---|
| CN | 103967578 | A | 8/2014 |
| DE | 10127219 | A1 | 11/2002 |
| DE | 102008030422 | A1 | 1/2009 |
| DE | 102010002082 | A1 | 8/2011 |
| JP | 2007154818 | A | 6/2007 |
| JP | 2013087758 | A | 5/2013 |
| JP | 2014015898 | A | 1/2014 |

* cited by examiner

METHOD FOR OPERATING A COMBUSTION ENGINE HAVING A SPLIT COOLING SYSTEM AND CYLINDER SHUTDOWN

CROSS REFERENCE TO RELATED APPLICATION

The present application claims priority to German Patent Application No. 102015201238.7, filed Jan. 26, 2015, the entire contents of which are hereby incorporated by reference for all purposes.

FIELD

The present disclosure relates to a method for operating a combustion engine comprising a split cooling system and at least one deactivatable cylinder.

BACKGROUND/SUMMARY

Optimum fuel efficiency is achieved when a combustion engine reaches an optimal operating temperature range. This is connected substantially with the friction of the moving parts, which is higher during cold start, particularly at a low ambient temperature. In addition, there is the increased viscosity of the cold engine oil, which likewise decreases only as the temperature increases. Moreover, exhaust emission figures of the combustion engine are also increased in the cold starting phase, this being attributable to the effectiveness of the exhaust gas aftertreatment devices arranged in the exhaust line, e.g., a catalytic converter, which increase as warm-up progresses.

For the reasons mentioned above, efforts in the development of combustion engines are focused on warming up as quickly as possible after cold starting. On the other hand, combustion engines may be operated within a certain temperature range. To keep within this range at the top, appropriate cooling measures are utilized. For this purpose, air cooled combustion engines have surface regions with a, generally finned, external structure in order to dissipate some of the operational heat to the ambient air via the surface area enlarged in this way. In contrast, the coolant flowing around the engine block and the cylinder head in water-cooled combustion engines absorbs a large part of the waste heat which arises. For this purpose, passages may be arranged in the housing wall of the combustion engine, forming a "coolant jacket" together with the coolant flowing through them.

Coolant is then passed through at least one suitable cooler arrangement via a self-contained cooling circuit to prevent overheating. During this process, at least some of the heat absorbed by the coolant is released to the ambient air via the cooler arrangement, which usually comprises at least one air/coolant heat exchanger.

In this way, it is possible to use the heat from the coolant, which is available in any case, to warm the vehicle interior independently of external factors as well for an engine cooling system combined with a vehicle heating system. For this purpose, a heating arrangement comprising at least one heating heat exchanger, which may be an air/coolant heat exchanger, is integrated into the cooling circuit. The operation of the vehicle heating system envisages that air is drawn in from outside and/or from the interior of the vehicle and guided past the heating heat exchanger or through the latter. During this process, the air absorbs some of the heat energy before being passed into the interior of the vehicle.

Apart from enhancing comfort in this way, however, vehicle heating systems also perform tasks associated with visibility. Above all, it is a clear view through the glazed portions of the vehicle which is at the forefront here. Thus, for example, low external temperatures have the effect that the water vapor in the interior precipitates on the windows. As a consequence, these can then become misted up or even ice over, clouding or obscuring the view.

Various embodiments of engine cooling systems in combination with vehicle heating systems are already known in the prior art. Some of these envisage a flow-free strategy, which is also referred to as a "no flow strategy". In simple systems, the circulation of the coolant through the coolant jacket of the combustion engine is interrupted, particularly during the cold starting phase, resulting in improved—because quicker—engine warm-up. However, such strategies are not suitable for vehicle heating systems that operate using coolant, which require an inflow of heated coolant in the event of a demand for heating, which typically arises already in the cold starting phase, this in turn requiring immediate abandonment of the no flow strategy.

In order also to be able to use a no flow strategy in combination with vehicle heating systems which desire a flow of coolant, compromise solutions in the form of "split cooling systems" have become established. These provide for division of the cooling circuit. In this case, the coolant jacket of the combustion engine can be divided into a part for the engine block and a part for the cylinder head. In this way, it is possible, for example, to supply the coolant jacket of the cylinder head with flowing coolant right from the starting of the combustion engine, while the coolant flow to the coolant jacket of the engine block is advantageously still shut off (no flow strategy).

Since the cylinder head, which contains the outlets for the exhaust gas, is the quickest to warm up in any case, that part of the coolant which is warmed up by the cylinder head can already be used for the vehicle heating system. In contrast, the shut off part of the coolant jacket contributes to the ability of the engine block to warm up more quickly without losing part of the heat energy required for this purpose to the rest of the coolant, which is flowing.

Another approach to reducing fuel consumption in combustion engines having a plurality of cylinders is seen in the deactivation of at least one of said cylinders. Shutting down individual cylinders is also known as "dynamic downsizing". The deactivation of one or more cylinders can be performed primarily in part-load operation of the combustion engine, in which only a correspondingly low power demand is required. The way in which shutdown is performed is based on the particular type of combustion engine. In addition to individual cylinder shutdown, this can take the form of deactivation of a complete cylinder bank, particularly in the case of V engines.

Systems of this kind are known from U.S. Pat. No. 7,966,978 B2 and DE 10 2008 030 422 A1, for example. These are concerned with the problem which sometimes occurs with cylinder shutdown, namely that of nonuniform temperature distribution within the combustion engine. This can occur, for example, with individual cylinders shut down over a prolonged period and can prove disadvantageous when the cylinders, which are then cold, are subsequently activated. In this case, the proposal is to separate the cylinders envisaged for possible deactivation and the cylinders envisaged for continuous operation in such a way that said cylinders are cooled by cooling water jackets that are separated from one another. Specifically, a combustion engine in the form of a V engine, the first cylinder bank of which is provided for permanently active operation and the second cylinder bank of which is provided for deactivatable operation, is disclosed. Both cylinder banks are surrounded by different cooling water jackets, wherein coolant flows only through the cooling water jacket of the first cylinder bank in the deactivated state of the second cylinder bank.

Here, the cooling water jackets of the two cylinder banks extend both around the region of the associated engine block which contains the cylinders and around the associated cylinder head of the respective cylinder bank.

In order to ensure separation between the cooling water jackets of the two cylinder banks, a bypass is provided, which allows the coolant from the cooling water jacket of the first cylinder bank to circulate through the cooling system while bypassing the second cylinder bank. In this way, more rapid warm-up of the first cylinder bank is achieved. If the shutdown of the second cylinder bank takes place during continuous operation, the bypass is closed if said bank is cooled down too much, with the result that the warm coolant from the coolant jacket of the activated first cylinder bank flows directly into the coolant jacket of the shut-down second cylinder bank and circulates onward from there. More even temperature distribution is achieved even when the second cylinder bank is deactivated.

Cylinder shutdown is based on operating the cylinder/s which is/are then still active at a higher load. Such operation is associated with improved fuel consumption, wherein, in particular, higher cylinder and/or exhaust gas temperatures are achieved.

JP 2014/015898 A likewise discloses a method for operating a combustion engine having cylinders that can be shut down. The cooling of the pistons thereof, which are arranged in the individual cylinders, is accomplished by an oil jet mechanism. If one or more cylinders are shut down, particularly in part-load operation of the combustion engine, the oil supply to the shut-down cylinder/s is simultaneously interrupted. In this way, excessive cooling of the cylinder/s which is/are still active is supposed to be prevented since otherwise some of the heat from the engine oil is lost via the regions of the combustion engine around the inactive cylinder/s.

Shutting down one cylinder or individual cylinders in combination with stopping admission to the cylinder/s which has/have been shut down allows extremely ecological and economical operation of combustion engines. Particularly the reduction of the mass to be warmed up owing to those parts through which there is no coolant flow in the shutdown phases allows rapid warm-up, from a cold start, of those regions which are active.

At the same time, complete shutdown of the cooling of the engine block and the cylinder head does not appear advisable since high temperatures, especially in the engine block, cause an advantageous reduction in friction. The warming, necessary for this purpose, in the cold starting phase is accomplished largely by means of the circulating coolant, which can in this way transfer the more rapid warm-up of the combustion chambers within the cylinder head at least partially to the engine block. It is the object of the present disclosure to achieve more rapid warm-up of the engine via more selective heating and/or cooling of the engine during cold-start.

In one example, the issues described above may be addressed by a method for deactivating a first cylinder group of an engine during a cold-start and flowing coolant to a second region of cylinder head coolant jacket corresponding to a second, active cylinder group while not flowing coolant to a first region corresponding to the first cylinder group, and where the first and second regions are fluidly sealed from each other. In this way, coolant flows to only regions of the cylinder head corresponding to active cylinders.

As one example, coolant is stagnated in an engine block coolant jacket, where the coolant is in contact with active and inactive cylinders. Therefore, the only flowing coolant flows through the second region of the cylinder head associated with the active cylinders. As the temperature of the coolant increases, the coolant may be mixed with coolant from the engine block in a coolant circuit, enabling more rapid warm-up of the cylinders (active and inactive). Once the cylinders are heated to a desired temperature, coolant may flow to all portions of the cylinder head such that heads of the deactivated cylinders may reach the desired temperature, thereby reducing emissions upon activation of the deactivated cylinders. This allows more rapid warming of an engine along with a catalyst reaching a light off temperature more rapidly.

It should be noted that the features and measures presented individually in the following description can be combined in any technically feasible manner and thus give rise to further embodiments of the present disclosure. It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
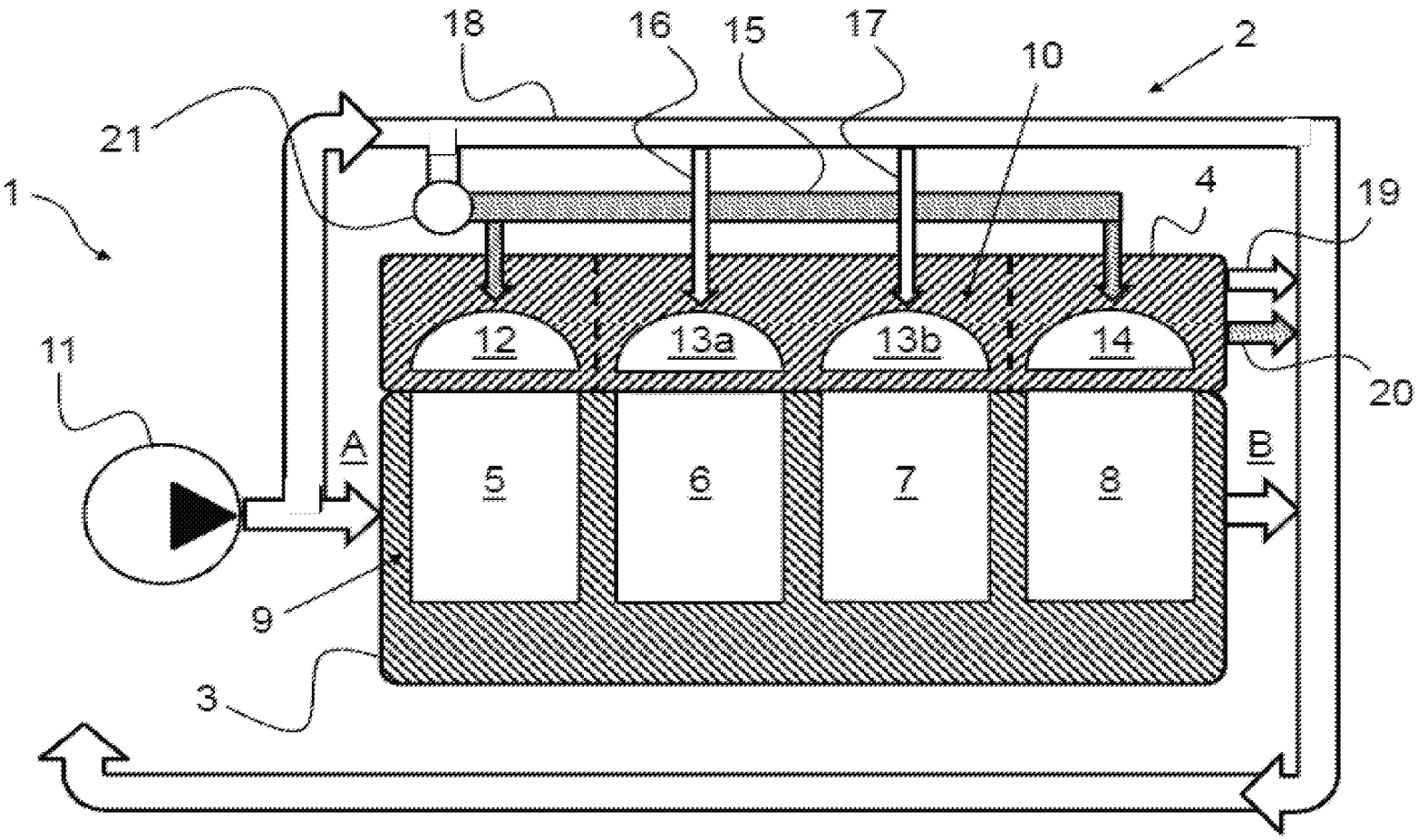
FIG. 1 shows, in schematic form, a section through a combustion engine 1 according to the present disclosure having a split cooling system 2, which has a possibility (not shown specifically) for cylinder shutdown.
Figure 2:
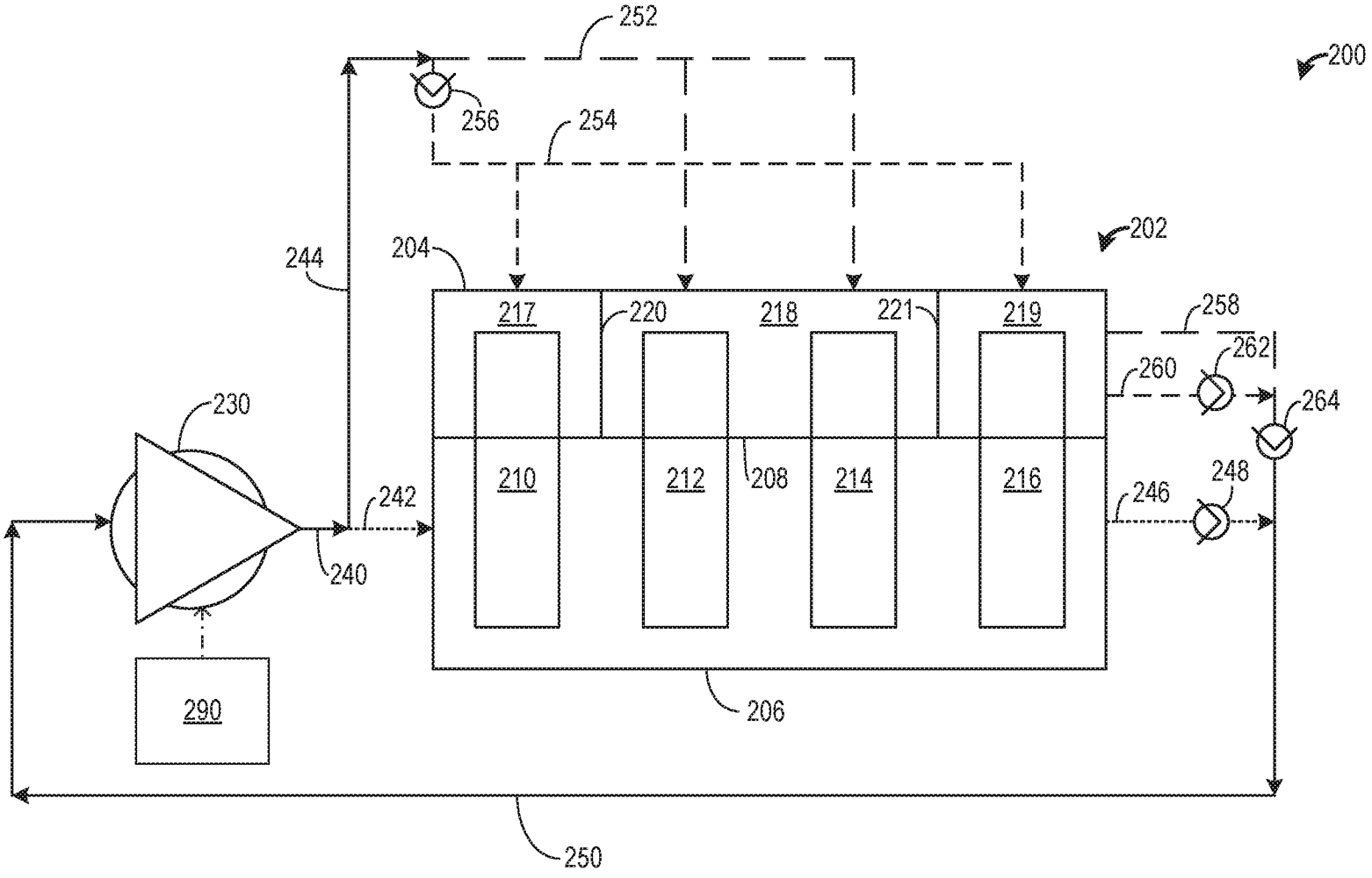
FIG. 2 shows a coolant system of the engine.
Figure 3:
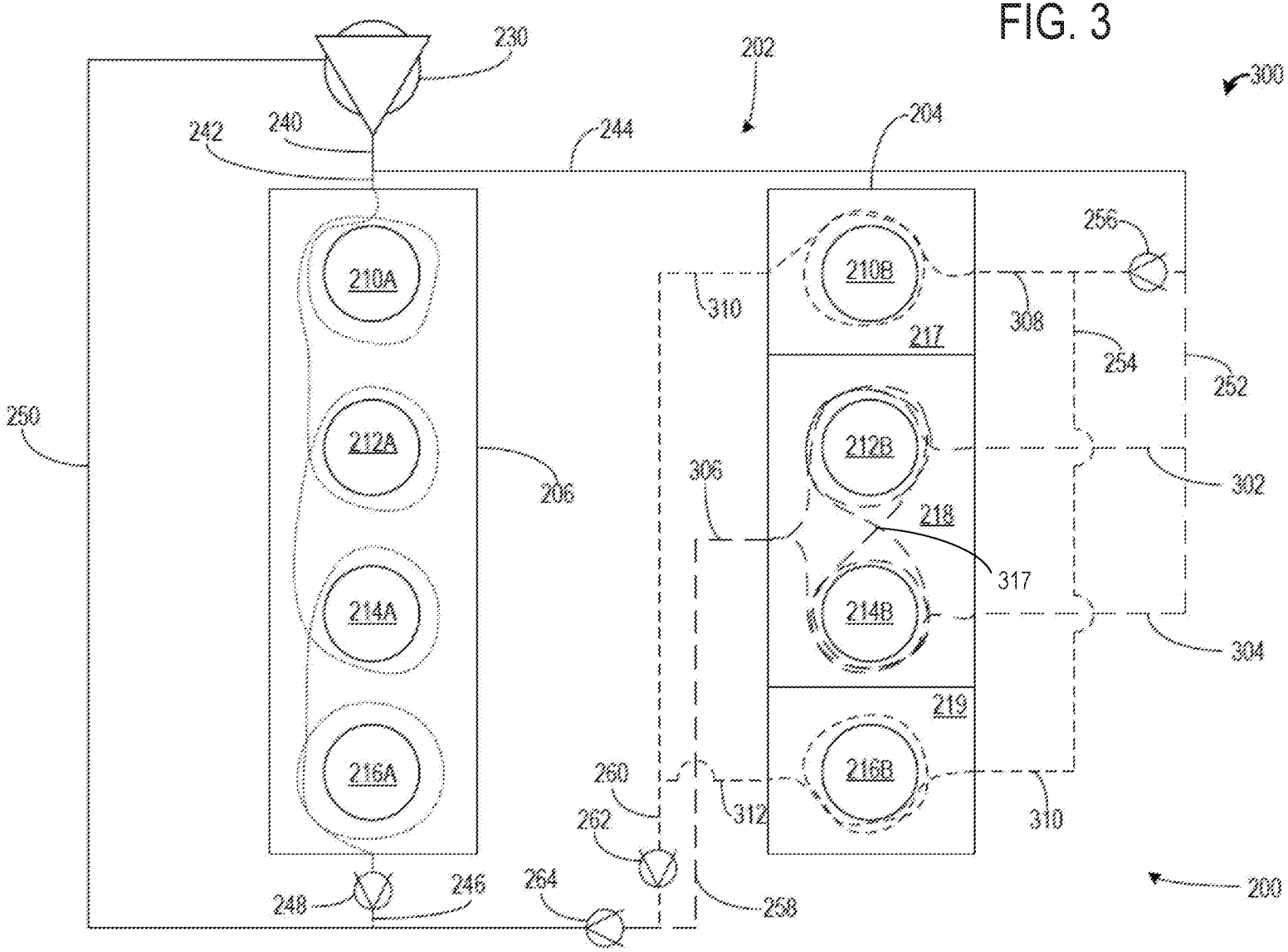
FIG. 3 shows a top-down view of the coolant system of the engine.

The following description relates to systems and method for a cooling circuit with coolant jackets corresponding to a cylinder head and an engine block. The coolant jacket of the head is fluidly sealed from the coolant jacket of the block. The coolant jacket of the head further comprises one or more regions corresponding to cylinders of the engine. A number of regions may be equal to a number of cylinders in one example. A coolant circuit fluidly coupled to the coolant jacket of the head and the coolant jacket of the block is shown in FIGS. 1 and 2. A top-down view of the coolant system is shown in FIG. 3. Coolant may flow to regions of the head corresponding to active cylinder while coolant flow to regions of the head corresponding to deactivated cylinders may be blocked during some conditions. A method for flowing coolant through the jackets and the coolant circuit is shown in FIG. 3.

A method according to the present disclosure for operating a combustion engine having a split cooling system is indicated below, wherein the combustion engine can be suitable in an advantageous way for use in connection with a motor vehicle.

The combustion engine has an engine block and a cylinder head. The combustion engine furthermore comprises at least two cylinders. The cylinders are formed within the engine block, being delimited at the top by the cylinder head, in which the combustion chambers are arranged. At least one of the cylinders can be shut down during the operation of the combustion engine.

The two component circuits can be connected to a coolant jacket surrounding the combustion engine. In each case, the coolant jacket is composed of at least two coolant jackets structurally separated from one another. More precisely, one of these two coolant jackets is arranged as a cylinder head coolant jacket on or around the cylinder head of the combustion engine. In contrast, the other coolant jacket is situated as an engine block coolant jacket on or around the engine block of the combustion engine. The cylinder head coolant jacket and the engine block coolant jacket can be separated fluidically from one another.

An arrangement of the split cooling system in which the engine block coolant jacket additionally included a small part of the cylinder head coolant jacket would also be conceivable.

A control means connected fluidically to the cooling circuit of the split cooling system can be provided in this arrangement. In its arrangement, the control means is then designed both to open and close the cooling circuits independently of one another in a desired manner and to a desired extent. Thus, for example, flow of the coolant within the engine block coolant jacket can be completely suppressed by the control means. This is furthermore independent of the cylinder head coolant jacket, thus allowing coolant also to continue flowing through the latter despite the engine block coolant jacket being shut off.

According to the present disclosure, division of the cylinder head coolant jacket is provided in such a way that said jacket is divided up into at least two subregions which can be separated fluidically from one another. Here, said subregions can be separated fluidically in an appropriate manner both from one another and from the engine block coolant jacket. In this case, each individual subregion of the cylinder head coolant jacket is associated with one of the cylinders. In other words, each individual subregion is provided for the purpose of supplying coolant to the respective region of the cylinder head delimiting the associated cylinder at the top.

According to this, it is now possible to shut down one of the cylinders during the operation of the combustion engine, for example, in which case coolant provided for cooling flows only through the subregion/s of the cylinder head coolant jacket which is/are associated with the switched-on and thus active cylinder/s.

Thus, for example, two cylinders of a combustion engine having four cylinders can be shut down, wherein coolant flows only through the subregions of the cylinder head coolant jacket which are associated with the cylinders that are still active. In contrast, coolant does not flow through the subregions of the cylinder head coolant jacket which are associated with the shut-down and thus inactive cylinders. As a result, the thermal mass, to be warmed up, of the combustion engine is in this way reduced to a minimum, thereby allowing the active cylinders, in particular, to be warmed significantly more quickly. In this way, the respectively active combustion chambers undergo a more rapid rise in temperature, especially from the cold starting phase.

Provision is made here to mix the flows of coolant from the engine block coolant jacket and the cylinder head coolant jacket outside the combustion engine, with the result that there is heat transfer and hence heat distribution within the combustion engine upon return of the mixed coolant. Such a measure may be beneficial in a warm-up phase of the combustion engine. Thus, the high temperature which is present within a very short time in the cylinder head coolant jacket can be used to transfer the heat thus present to the engine block coolant jacket.

The resulting advantage comprises in a more rapid rise in the exhaust gas temperature from the active combustion chambers and an associated increase in the speed of light off of the catalytic converter arrangement. It is thereby possible to achieve significantly decrease exhaust emission even a short time after the starting of the combustion engine. Moreover, there is increased combustion of the fuel, and this likewise leads to a reduction in emissions by the exhaust gases.

Overall, the thermal mass, to be warmed up, of the combustion engine around the subregion/s of the cylinder head coolant jacket of the inactive cylinder/s is thus advantageously reduced, while the engine block can simultaneously be warmed up by the coolant heated up by the fired cylinders and the circulation of said coolant. As a result, the coolant can be warmed up more quickly, and can subsequently be used for quickly warming up the engine block, resulting in corresponding advantages in terms of friction within the engine block.

It is possible that the coolant in the engine block coolant jacket can be held in a no flow state while coolant can flow through the subregion of the cylinder head coolant jacket which is associated with the at least one active cylinder. If more than one cylinder is active, i.e. switched on, there can be a corresponding flow of coolant through the subregions of the cylinder head coolant jacket which are associated with the active cylinders, while the coolant in the engine block coolant jacket is likewise kept in a no flow state.

In this way, the thermal mass to be warmed up could be reduced and the heat transfer in the engine block from the internal locations relevant to friction to the outer structure could be greatly reduced, something that could be suitable, for example, for the starting phase of the combustion engine, especially from a cold start. At the same time, the thermal mass to be warmed up could be further reduced by likewise not supplying coolant to the inactive, i.e. unfired, cylinders. According to this, the coolant could in fact flow only through the subregion associated with the switched-on cylinder or through the subregions of the cylinder head coolant jacket which are associated with the switched-on cylinders, while the other parts of the coolant jacket of the combustion engine are kept in a no flow state.

As an alternative, a measure could be provided which includes supplying the engine block with a coolant flow. Thus, in another phase of the operation of the combustion engine, there could also be a flow of coolant through the engine block, while there would likewise be a flow of coolant through the at least one subregion of the cylinder head coolant jacket which is associated with the at least one active cylinder. In other words, it would in this way be possible to have a flow of coolant through the entire coolant jacket of the combustion engine with the exception of the subregion or subregions of the cylinder head coolant jacket which is/are associated with the inactive, i.e. shut-down, cylinder/s.

Depending on the routing of the coolant, the coolant of the engine block coolant jacket could thus circulate only in the latter or within a small, closed circuit, for example, wherein there does not have to be in a mixing with the coolant of the cylinder head coolant jacket. In other words, there could thus be separate flows of coolant through the engine block coolant jacket and at least one or more subregions of the cylinder head coolant jacket, with no heat exchange between them.

As an alternative, the flows of coolant from the engine block coolant jacket and the cylinder head coolant jacket could also be mixed, resulting in heat transfer and hence heat distribution within the combustion engine. Such a measure could be preferred in a warm-up phase of the combustion engine, for example. This would be advantageous particularly when a sufficiently high temperature has already been achieved in the cylinder head coolant jacket and heat can thus be passed on to the engine block coolant jacket. In this case, the thermal mass, to be warmed up, of the combustion engine is reduced in an advantageous manner by the subregion/s of the cylinder head coolant jacket of the inactive cylinder/s, while the engine block can be simultaneously warmed up by the coolant heated up by the fired cylinders and the circulation thereof. The coolant can thereby be warmed more rapidly, and can then be used for rapid warming of the engine block, resulting in corresponding advantages in terms of friction within the engine block.

The coolant warmed by means of at least one fired cylinder can be used to simultaneously warm and/or maintain the temperature of at least one of the inactive cylinders, in particular in that part of the cylinder head which delimits it at the top. Thus, the coolant flowing through one or more subregions of the active cylinder/s can then be passed through one or more subregions of the cylinder head coolant jacket of inactive cylinders in order to transfer the previously absorbed heat energy at least partially to the unfired cylinders. As a result, uniform heat distribution within the cylinder head is achieved in this way. Such a measure is suitable particularly for those phases in which the combustion engine has reached its operating temperature and excess heat energy then arises.

Particularly in phases in which a demand for higher or high power is made on the combustion engine, it is envisaged that all the cylinders present are switched on and thus activated. During this phase, it is regarded as advantageous if there is a flow of coolant through all the subregions of the cylinder head coolant jacket. At the same time, there can preferably also be a flow of coolant through the engine block coolant jacket.

The present disclosure shows an exemplary method for operating a combustion engine with cylinder shutdown, in which the split cooling system is divided in an advantageous way and the coolant flows are used selectively. Particularly the division of the cylinder head coolant jacket into individual, mutually independent subregions makes it possible for the coolant to flow only through the respectively fired active cylinder/s in the region of the cylinder head, while the subregions or remaining subregions of the inactive cylinders are as it were decoupled from the thermal mass to be warmed up. Extremely rapid warming of the active regions of the combustion engine is thereby achieved, and this can be recognized especially in improved emission figures.

The present disclosure is also directed to a combustion engine having a split cooling system. The combustion engine is particularly preferably suitable for carrying out the method according to the disclosure indicated above. It is furthermore envisaged that the combustion engine according to the present disclosure can advantageously be arranged in a motor vehicle. Here, the split cooling system can be used, in particular, both to cool the combustion engine and to heat the vehicle interior.

The combustion engine according to the present disclosure comprises an engine block and a cylinder head, wherein the engine block has an engine block coolant jacket and the cylinder head has a cylinder head coolant jacket. Here, the engine block coolant jacket and the cylinder head coolant jacket are constructed in such a way that they can be separated fluidically from one another. The combustion engine furthermore comprises at least two cylinders, of which at least one can be shut down during the operation of the combustion engine. According to the present disclosure, the cylinder head coolant jacket is divided into at least two separate subregions, which can be separated fluidically both from one another and from the engine block coolant jacket. In this arrangement, each subregion of the cylinder head coolant jacket is associated with one of the cylinders. The split cooling system is furthermore designed in such a way that the engine block coolant jacket is connected fluidically to the subregion/s of the cylinder head coolant jacket of the respectively switched-on cylinder/s.

FIG. 1 shows the combustion engine 1 comprising an engine block 3, arranged at the bottom in the plane of the drawing based on the illustration in FIG. 1, and a cylinder head 4, which is arranged above the engine block 3 in the plane of the drawing and is connected thereto. Formed within the combustion engine 1 are individual cylinders 5-8, which are delimited at the top by the cylinder head 4.

The engine block 3 comprises an engine block coolant jacket 9, which is connected fluidically to the split cooling system 2. The cylinder head 4, on the other hand, has a cylinder head coolant jacket 10, which is likewise connected fluidically to the split cooling system 2. The engine block coolant jacket 9 and the cylinder head coolant jacket 10 are separated structurally from one another in such a way that coolant (not shown specifically) arranged within the split cooling system 2 can flow through them independently of each other. For this purpose the split cooling system 2 has a pump arrangement 11, which enables circulation of the coolant. The direction of flow of the coolant which is possible here is indicated specifically by arrows representing the individual lines of the split cooling system 2.

The engine block 3 has an inlet side A and an outlet side B situated opposite the inlet side A. Via the inlet side A, coolant can flow out of the split cooling system 2, through the engine block coolant jacket 9, toward the outlet side B, from where it flows back into the split cooling system 2. On its way through the engine block coolant jacket 9, the coolant flows around the individual cylinders 5-8 at least locally in such a way that heat energy coming from the cylinders 5-8 can be absorbed by the coolant and/or heat energy contained in the coolant can be transferred to those regions of the engine block 3 which laterally delimit the individual cylinders 5-8. In other words, the coolant serves primarily to cool the engine block 3 or to warm it by means of correspondingly hotter coolant.

In viewing the cylinder head 4, it becomes clear that the cylinder head coolant jacket 10 thereof is divided into individual subregions 12, 13*a*, 13*b*, 14, which are separated structurally and thus fluidically from one another. This is illustrated in detail in FIG. 1 by the vertical dashes shown spaced apart in the region of the cylinder head 4.

In the present case, the cylinder head coolant jacket 10 has four subregions 12, 13*a*, 13*b*, 14, of which a first subregion 12 is associated with a first cylinder 5 and a fourth subregion 14 is associated with a fourth cylinder 8. In contrast, two subregions 13*a*, 13*b* in the form of a second subregion 13*a* and a third subregion 13*b*, which are situated between the first and fourth subregions 12, 14, are associated both with a second cylinder 6 and with a third cylinder 7. To be specific, the second subregion 13*a* is here associated with the second cylinder 6 and the third subregion 13*b* is associated with the third cylinder 7.

As is apparent, the first subregion 12 and the fourth subregion 14 are connected fluidically to one another by a common feed line 15 of the split cooling system 2, whereas the central second and third subregions 13*a*, 13*b* are each connected fluidically by a branch line 16, 17 to a line segment 18 of the split cooling system 2. The coolant is discharged from the respective subregions 12-14 via discharge lines 19, 20, of which a first discharge line 19 is connected fluidically to the two central second and third subregions 13*a*, 13*b* and a second discharge line 20 is connected fluidically to the two outer subregions 12, 14; more specifically, they are connected fluidically to the first and fourth subregions 12, 14 in a manner not shown specifically. Said discharge lines 19, 20 are connected fluidically to the split cooling system 2, thus allowing the coolant passing through the cylinder head 4 to be fed back into the split cooling system 2 in the manner of a closed circuit.

The feed line 15 is furthermore connected fluidically to the line segment 18 by a switching arrangement 21. The switching arrangement 21 can be a switching valve, for example. For this purpose, the switching arrangement 21 is designed to at least partially prevent flow of the coolant into the feed line 15, depending on its switching position. By means of the switching arrangement 21, the feed line 15 can preferably be switched so as to be without flow, particularly during the operation of the combustion engine 1.

By means of this illustrative embodiment, it is now possible for only the two central second and third subregions 13*a*, 13*b* of the cylinder head coolant jacket 10 to be supplied jointly with coolant via the two branch lines 16, 17 during the operation of the combustion engine 1, while the first and fourth subregions 12, 14 are jointly in contact with coolant which is stationary and thus not flowing. Such a measure is preferably carried out in the case (shown here) where the two outer cylinders 5, 8, i.e. the first and fourth cylinders 5, 8 of the combustion engine 1, are shut down, while the two central cylinders 6, 7, more specifically the second and third cylinders 6, 7, are switched on and thus active.

Here, active or switched on means that corresponding combustion processes are taking place in said cylinders 6, 7, which may include one or more of a fuel injection and spark. In this case, the flow of coolant can be controlled by means of the switching arrangement 21 in such a way that the coolant flows through the central second and third subregions 13*a*, 13*b* of the cylinder head coolant jacket 10 via the branch lines 16, 17 and leaves them via the first discharge line 19. The central cylinders 6, 7, more specifically the second and third cylinders 6, 7, can thereby likewise be cooled in the associated regions of the cylinder head 4.

In contrast, the above-described switching position of the switching arrangement 21 can also be used likewise to warm the outer cylinders, more specifically the first and fourth cylinders 5, 8, which are still inactive, i.e. shut down, by means of previously warmed coolant and/or to keep them at operating temperature.

It may also be possible for coolant to flow through all the subregions of the cylinder head coolant jacket when all the cylinders are active, in which case the switching arrangement 21 is switched correspondingly so as to allow flow through to the line segment 18.

FIG. 2 shows a coolant circuit 200 for directing coolant flow through an engine 202. The engine 202 may be used as engine 1 in the embodiment of FIG. 1. As described above, the coolant circuit 200 may be included in a split cooling system, wherein hotter coolant from the engine may be guided to a pathway comprising a vehicle heating arrangement for heating a vehicle interior. In one example, the cylinder head may be coupled to the passage comprising the vehicle heating arrangement due to hot exhaust gases flowing adjacent to the cylinder head. The engine 202 is divided into two sections namely, a cylinder head 204 and an engine block 206. The cylinder head 204 may be defined as a portion of the engine 202 sitting atop one or more combustion chambers in the block 206, and where the head further comprises intake/exhaust valves, fuel injectors, and/or spark plugs. The head 204 comprises an upper coolant jacket fluidly separated from a lower coolant jacket located in the engine block 206. Therefore, a barrier, membrane, wall, or other suitable fixture capable of preventing fluid transfer between the head 204 and block 206 is located between the head and the block as indicated by line 208. Line 208 may also indicate a thermally insulating feature which may both hermetically seal the head 204 from the block 206 and thermally isolate the head from the block. The head 204 and the block 206 comprise no other inlets and/or outlets other than those described below.

As shown, the engine 202 comprises four cylinders, a first cylinder 210, a second cylinder 212, a third cylinder 214, and a fourth cylinder 216. The engine 202 is an in-line four cylinder engine as shown. However, the engine 202 may comprise other suitable numbers of cylinder in other suitable configurations, for example, six cylinders in a V-configuration. Coolant in the upper coolant jacket may flow around intake and exhaust passages and coolant in the lower coolant jackets may flow around the cylinders. Coolant in the upper coolant jacket may be hotter than coolant in the lower coolant jacket due to its proximity to exhaust gas flowing in the cylinder head 204.

The engine 202 may comprise a device suitable for deactivating one or more cylinders of the first 210, second 212, third 214, and fourth 216 cylinders. In one example, the device may be a hydraulic lash adjuster. Deactivating a cylinder may include one or more of closing an intake valve, closing an exhaust valve, disabling fuel injections, and deactivating spark. A piston of the cylinder may continue to pump despite a deactivation of the cylinder. In this way, frictional heat losses may occur during cylinder deactivation.

In one example, the first 210 and fourth 216 cylinders may comprise cylinder deactivating devices, where the device may adjust the operation of the two cylinders as described above. The second 212 and third 214 cylinders may not comprise cylinder deactivated devices such that the two cylinders are not able to be deactivated. In this way, the head 204, specifically the upper coolant jacket, may be separated into regions corresponding to each of the four cylinders. A first region 217 corresponds to the first cylinder 210, a second region 218 corresponds to the second 212 and third 214 cylinders, and a third region 219 corresponds to the fourth cylinder 216. In some embodiments, additionally or alternatively, a numbers of regions in the head may be equal to a number of cylinders. The first 217, second 218, and third 219 regions are fluidly sealed from each other, as shown by lines 220, 221. A barrier, membrane, wall, or other suitable fixture capable of preventing fluid transfer is located between the regions. Furthermore, the regions may be thermally separated from one another via a thermally insulating wall, where the wall is double lined with a space located therebetween filled with insulating material or a vacuum element. The second region 218 may be larger than the first region 217 and the third region 219 due to its association with the second 212 and the third 214 cylinders. In some examples, the second region 218 may be divided into two regions corresponding to the second cylinder 212 and the third cylinder 214. In the description below, the first 210 and the fourth 216 cylinders may be deactivatable while the second 212 and the third 214 are not deactivatable.

Coolant may occupy four different compartments of the engine 202, three (first region 217, second region 218, and third region 219) located in the upper coolant jacket in the head 204 and one located in the lower coolant jacket in the block 206. Specifically, coolant may enter the upper coolant jacket via the first region 217, the second region 218, and the third region 219 while a remaining portion of coolant may enter the lower coolant jacket. An amount of coolant delivered to the lower coolant jacket, the first 217, second 218, and third 219 regions may be mutually exclusive and adjusted by a coolant pump 230.

The coolant pump 230 may be used to direct coolant to the upper coolant jacket or the lower coolant jacket. The coolant pump 230 may be coupled to and capable of receiving signals from a controller 290, where the signals may adjust an operation of the coolant pump. In one example, the controller 290 may adjust an amount of coolant the coolant pump 230 delivers to the upper coolant jacket and/or the lower coolant jacket.

Arrows indicate a direction a coolant flow through the coolant circuit 200 and the engine 202. Lines of the coolant circuit 200 are dashed, where small dashed lines indicate coolant lines to and from the lower coolant jacket, medium dashed lines indicate coolant lines to and from the first 217 and third 219 regions of the upper coolant jacket, and large dashed lines indicate coolant lines to and from the second region 218 of the upper coolant jacket. Large dashed lines are bigger than medium dashed lines which are bigger than small dashed lines. Solid lines of the coolant circuit 200 indicate coolant lines which may comprise a mixture of coolant due to merging flows from the lower coolant jacket, the first region 217, the second region 218, and the third region 219.

Coolant may flow from the coolant pump 230 into a first feed line 240, where the first feed line divides into a lower coolant jacket inlet 242 and into a second feed line 244. The lower coolant jacket inlet 242 provides coolant to the lower coolant jacket. Coolant in the lower coolant jacket flows around bodies of each of the first 210, second 212, third 214, and fourth 216 cylinders. Coolant in the lower coolant jacket may flow out of the engine 202 via a lower coolant jacket outlet 246 when a lower coolant jacket outlet valve 248 is in an open position. The lower coolant jacket outlet valve 248 may be a control valve, where the valve may be moved to the open position or a closed position via a signal from the controller 290. In another embodiment, the lower coolant jacket outlet valve 248 may be a wax-actuated solenoid valve, where the valve may move to an open position based on a temperature of coolant in the lower coolant jacket. In one example, the valve 248 may open in response to a temperature of coolant in the lower coolant jacket being greater than a threshold coolant temperature. Coolant flowing through the lower coolant jacket outlet valve 248 flows into return passage 250 and is directed back to the coolant pump 230. In some examples, a heat transfer device (e.g., radiator) may be located in the return passage 250 along with a corresponding bypass of the heat transfer device.

Coolant in the second feed line 242 may continuously flow into a second region passage 252 while selectively flowing into a first and third region passage 254 based on a position of a first and third region passage valve 256. When the first and third region passage valve 256 is in an open position, then coolant from the second feed line 242 flows into the first and third region passage 254, where the coolant then flows to the first region 217 and the third region 219. Thus, then the first and third region passage valve 256 is closed, coolant from the second feed line 242 does not flow into the first and third region passage 254. The first and third region passage valve 256 may be substantially identical to the lower coolant jacket outlet valve 248.

Coolant in the second region passage 252 flows into the second region 218, where the coolant may flow adjacent to heads of the second cylinder 212 and the third cylinder 214. Coolant from the second region 218 flows out of the second region outlet 258 and into the return line 250 when a cylinder head outlet valve 264 is in an open position. The cylinder head outlet valve 264 may be a control valve, wax valve, and/or solenoid valve, where a position of the cylinder head outlet valve is adjusted based on a coolant temperature of the cylinder head 204. The coolant from the second region may mix with coolant from the lower coolant jacket in the return line 250. As shown, the coolant circuit 200 does not comprise a valve on portions of the coolant circuit leading to the second region 218. In this way, the second region of the upper coolant jacket of the cylinder head 204 continuously receives coolant flow during engine operation, and where coolant flow is not stagnated.

Coolant in the first and third region passage 254 flows into the first region 217 and third region 219, where the coolant may flow adjacent to head of the first cylinder 210 and the fourth cylinder 216, respectively. Coolant from the first region 217 and the third region 219 may flow out of the engine 202 via the first and third region outlet 260 to the return line 250 when the first and third region outlet valve 262 and the cylinder head outlet valve 264 are in open positions. The first and third region outlet valve 262 may be a control valve or a wax-actuated solenoid valve, where the valve 262 may be actuated based on a temperature of coolant or an engine operation, as will be described below. The cylinder head outlet valve 264 is located downstream of the first and third region outlet valve 262, where the cylinder head outlet valve 264 may adjust coolant flow out of the cylinder head while the first and third region outlet valve 262 may adjust coolant flow only out of the first 217 and third 219 regions. In this way, the coolant circuit 200 may stagnate coolant in the first 217 and third 219 regions without mixing coolant in the first and third regions with coolant in the second region or with coolant in the lower coolant jacket of the block 206.

In some embodiments where a number of regions in the cylinder head is equal to a number of cylinders in the engine or a bank of the engine, a valve may be located upstream of each of the regions such that a flow of coolant to each region may be mutually exclusive. Furthermore, each of the cylinders may comprise a deactivation device, where any of the cylinders may be deactivated based on a crankshaft position, firing order, or other engine condition. Thus, coolant flow may be disabled to any cylinder of the engine based on a deactivation of the cylinder. Additionally or alternatively, in some embodiments, one of the first and third region outlet valve 262 or the cylinder head outlet valve 264 may be omitted.

Thus, coolant in the return line 250 may comprise coolant from the first 217, second 218, and third regions 219 along with coolant from the lower coolant jacket. A temperature of the coolants may equilibrate as the coolants mix in the return line 250. The mixture is divided at the coolant pump 230 as described above. In this way, coolant from the head 204 may flow to the block 206 via the coolant circuit 200. A method for controlling the flow of coolant during engine start and engine operation is described below. The method includes routing coolant based on activated and deactivated cylinders.

In this way, a coolant circuit is fluidly coupled to a cylinder head and an engine block of an engine. Coolant in the cylinder head is hermetically sealed from coolant in the engine block. The cylinder head further comprises three regions, a first region, a second region, and a third region. The first and third regions correspond to cylinders comprising a cylinder deactivating mechanism while the second region corresponds to cylinders that may not be deactivated. The first, second, and third regions are hermetically sealed from one another. Coolant in the coolant circuit may flow to the engine block, the first region, the second region, and/or the third region.

It should be appreciated that the illustration of FIG. 2 illustrates various cooling passages and flow paths coupled together in the manner illustrated, with certain sections of the path leading directly from one area to another, and so on. Such disclosure includes each of the various connections being direct connections as shown, and the illustration of a lack of connection or direct coupling includes, as an example, disclosure of that lack of connection or direct coupling. Further, the flow connections illustrate an example where the lack of illustration of an additional element or device in between includes disclosure of the lack of that element or device from the place at which it is not depicted.

FIG. 3 shows a top-down view 300 of the coolant system 200 and the engine 202. Therefore, components previously introduced may be similarly numbered in subsequent figures. In the embodiment of FIG. 3, the cylinder head 204 is separated from the cylinder block 206 to further depict a flow of coolant through the upper coolant jacket and the lower coolant jacket, respectively. As described above, the upper coolant jacket is divided into subregions, where the subregions are associated with one or more cylinder heads. Specifically, a first subregion 217 is associated with a first cylinder head 210B, a second subregion 218 is associated with second 212B and third 214B cylinder heads, and a third subregion 219 is associated with a fourth cylinder head 216B. First 210B, second 212B, third 214B, and fourth 216B cylinder heads correspond to first 210A, second 212A, third 214A, and fourth 216A cylinder bodies.

As described above with respect to FIG. 2, coolant flow through the lower coolant jacket in the engine block 206 includes a pump 230 directing coolant through a first feed line 240, where a portion of coolant from the first feed line 240 flows through a lower coolant jacket inlet 242, and into the lower coolant jacket of the engine block 206. Coolant in the lower coolant jacket of the engine block may flow adjacent to the cylinder bodies 210A, 212A, 214A, and 216A. Coolant flowing adjacent to one of the cylinder bodies may be fluidly coupled to coolant flowing adjacent to a different one of the cylinder bodies. In this way, coolant in the engine block may interchangeably flow to any of the cylinder bodies 210A, 212A, 214A, and 216A. Coolant may flow out of the lower coolant jacket of the cylinder block 206 via the lower coolant jacket outlet 246 when a lower coolant jacket outlet valve 248 is in an at least partially open position (e.g., between fully open and fully closed). Coolant from the lower coolant jacket outlet 246 flows into the return line 250, where the coolant is redirected toward one or more of a heat exchanger, an auxiliary coolant circuit, and the coolant pump 230. In this way, coolant may flows through the lower coolant jacket of the engine block 206 without flowing into the upper coolant jacket of the cylinder head 204.

A remaining portion of coolant from the first feed line 240 may flow through a second feed line 244, where the coolant is directed to one or more of a second region passage 252 and a first and third region passage 254. Coolant from the second feed line 244 may flow into the first and third region passage 254 when a first and third region passage valve 256 is in an open position, as described above. Conversely, coolant from the second feed line 244 may continually flow through the second region passage 252 during engine operations including coolant flow through the coolant circuit 200.

Coolant in the second region passage may flow into a first second region inlet 302 and a second region inlet 304. The first second region inlet 302 may correspond to the second cylinder head 212B and the second region inlet 304 may correspond to the third cylinder head 214B. Coolant flowing from the first second region inlet 302 into the second region 218 may mix (merge) with coolant flowing from the second region inlet 304 into the second region 218. In this way, coolant flowing adjacent to the second cylinder head 212B through crossover path 314 may mix with coolant flowing adjacent the third cylinder head 214B. Coolant from the second region 218 flows out via a shared second region outlet 306 into a second region outlet 258, which directs coolant into the return line 250. In this way, coolant in the second region 218 does not flow into the first region 217 or the third region 219 and does not flow adjacent to the first cylinder head 210B or the fourth cylinder head 216B.

Coolant in the first and third region passage 254 may flow into a first region inlet 308 and/or a third region inlet 310. An amount of coolant flowing into the first region inlet 308 may be equal to an amount of coolant flowing into the third region inlet 310. In some examples, a valve may be located in one or more of the first region inlet 308 and the third region inlet 310 such that an amount of coolant directed to the first region 217 and the third region 219 is adjustable.

Coolant in the first region inlet 308 flows into the first region 217, where the coolant may flow around the first cylinder head 210B. Coolant from the first region 217 flows out of the cylinder head 204 via a first region outlet 310, which directs coolant into a first and third region outlet 260, when a cylinder head outlet valve 264 is in an open position. The cylinder head outlet valve 264 may be in a closed position to stagnate coolant in the cylinder head 204 based on a coolant temperature. As an example, coolant may be stagnated in the cylinder head 204 if a cold-start is occurring and coolant in the first 217, second 218, and third 219 regions is not equal to the threshold coolant temperature.

Coolant in the third region inlet 310 flows into the third region 219, where the coolant may flow around the fourth cylinder head 216B. Coolant from the third region 219 flows out of the cylinder head 204 via a third region outlet 312, which directs coolant into the first and third region outlet 260. In this way, coolant in the first region 217 and the third region 219 does not flow into the second region 218. Furthermore, coolant in the first region 217 is not directly fluidly coupled to the third region 219 such that coolant flowing adjacent the first cylinder head 210B may not readily mix with coolant adjacent the fourth cylinder head 216B. Coolant in the first and third region outlet 260 may flow into the return line 250 when a first and third region outlet valve 262 and a cylinder head outlet valve 264 are in an open position. If the-first and third region outlet valve 262 is in a closed position, then coolant in the first region 217 and the third region 219 may be stagnant. If the cylinder head outlet valve 264 is in a closed position, then coolant in the cylinder head may be stagnant. The first region 217 and the third region 219 are fluidly coupled via the first and third region outlet 260. As shown, the first and third region outlet 260 is located outside of the cylinder head 204. In some embodiments, the first region 217 may be fluidly coupled to the third region 219 via an optional passage located in the cylinder head 204. The optional passage fluidly connects the first region 217 to the third region 219 while preventing coolant from the first 217 and third 219 region from fluidly or thermally communicating with coolant in the second region 218. Thus, the optional passage traverses the second region 218 and fluidly connects the first region 217 to the third region 219.

Coolant in the return line 250 comprises coolant from the lower coolant jacket of the engine block 206 and coolant from the upper coolant jacket of the cylinder head 204. Thus, coolant from the block 206 and the head 204 may mix in the return line 250, where the coolant mixture is directed to the pump 230 to be diverted back to either the engine block 206 or the cylinder head 204. This may allow more uniform heating of the engine 202.

Figure 4:
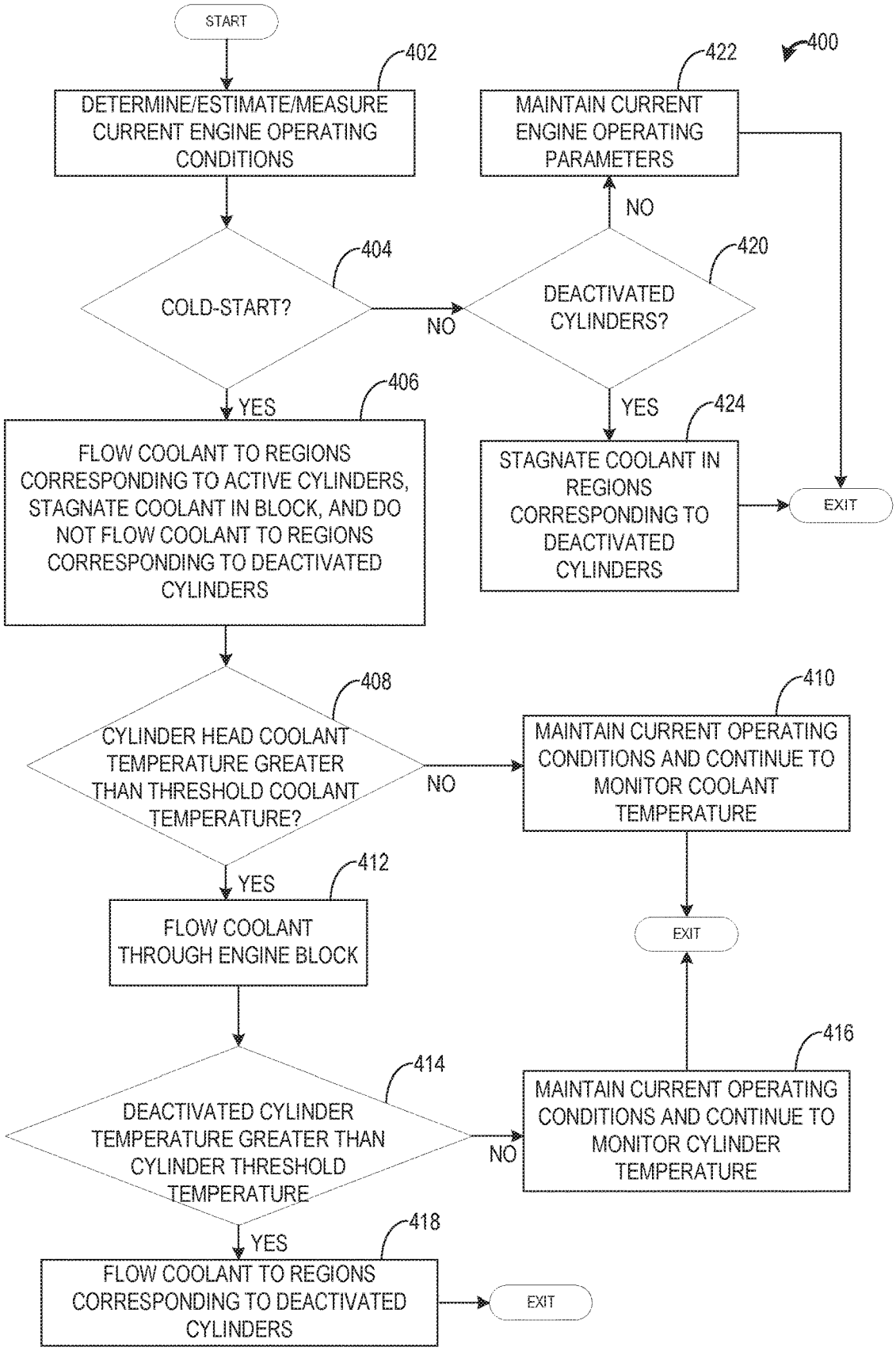
FIG. 4 shows a method for controlling coolant flow during engine operation.

FIG. 4 show a method 400 for flowing coolant through a coolant circuit of an engine, where the engine comprises at least one deactivatable cylinder. Instructions for carrying out method 400 may be executed by a controller (e.g., controller 290 in the embodiment of FIG. 2) based on instructions stored on a memory of the controller and in conjunction with signals received from sensors of the engine system, such as the sensors described above with reference to FIG. 2. The controller may employ engine actuators of the engine system to adjust engine operation, according to the methods described below. Method 400 may be described in reference to components previously introduced above with reference to FIGS. 1 and 2.

Method 400 begins at 402, where the method 400 determines, estimates, and/or measures current engine operating conditions. The current engine operating conditions may include but are not limited to engine load, engine temperature, vehicle speed, manifold vacuum, catalyst temperature, and air/fuel ratio.

At 404, the method 400 includes determining if a cold-start is occurring. A cold-start may be determined based on an engine temperature, where the engine temperature is less than a desired operating temperature range (e.g., 185-205° F.). During a cold-start, at least one cylinder of an engine (e.g., first 210 and fourth cylinders 214 in the embodiment of FIG. 2) may be deactivated. This may allow a smaller amount of thermal matter (coolant) to be heated during the cold-start, as will be described below, which further enables a catalyst light off to occur more rapidly compared to an engine firing all cylinders during the cold-start.

If a cold-start is occurring, then the method 400 proceeds to 406 to flow coolant to regions of the cylinder head corresponding to activated cylinders, stagnate coolant in the engine block, and not flow coolant to remaining regions of the cylinder head corresponding to deactivated cylinders. For example, a coolant pump (coolant pump 230 of FIG. 2) directs coolant to the engine block and the cylinder head. Coolant in the engine block flows through all of the engine block and is in thermal communication with each of the cylinders of the engine, independent of the cylinders being activated or deactivated. Coolant flowing to the cylinder head is directed to flow only to the region corresponding to active cylinders (second region 218 corresponding to the second 212 and third 214 cylinders). Thus, coolant is not delivered to the first 217 and third 219 regions corresponding to the first 210 and fourth 214 cylinders, respectively, by actuating a first and third region passage valve to a closed position. Furthermore, coolant in the second region is in thermal communication with the active cylinders and does not flow into the first and/or third regions or thermally communicate with the deactivated cylinders. In this way, a smaller amount of material is heated during the cold-start due to cylinders being deactivated and coolant not flowing to regions associated with the deactivated cylinders. Thus, an engine may warm-up more quickly and a catalyst may reach a light-off temperature more rapidly.

Additionally or alternatively, the method 400 may further include stagnating the coolant in the cylinder head during the cold-start to allow coolant in the cylinder head to warm-up. A cylinder head outlet valve (e.g., cylinder head outlet valve 264 of FIG. 2) may actuate based on a temperature of coolant in the cylinder head. The cylinder head outlet valve may be closed when a temperature of coolant in the second region is less than a threshold cold-start coolant temperature, where the threshold cold-start coolant temperature may be based on a coolant temperature greater than or equal to 100° F. Thus, the coolant may remain in the cylinder head until it reaches the threshold cold-start coolant temperature. Coolant may be stagnated in the cylinder head for engine starts including deactivated cylinders and for engine starts not including deactivated cylinders. If first and fourth cylinders are deactivated, then coolant stagnated in the cylinder head includes stagnating coolant in the second region while not flowing coolant to the first and third regions of the cylinder head.

At 408, the method 400 includes determining if a cylinder head coolant temperature of coolant in the regions corresponding to the activate cylinders is greater than a threshold coolant temperature, where the threshold coolant temperature is based on a lower end of a desired coolant operating temperature range (e.g., 185° F.). In this way, a thermostat arrangement may be located along the coolant circuit or in the engine. The coolant in the cylinder head may increase to the desired temperature before coolant in the engine block due to its proximity to hot exhaust gas flowing through the cylinder head. If the coolant is not greater than the threshold coolant temperature, then the method 400 proceeds to 410 to maintain current operating conditions and to continue to monitor coolant temperature. Thus, coolant remains stagnant in the engine block and coolant only flows to the regions corresponding to the active cylinders in the head.

If the coolant temperature is greater than the threshold coolant temperature, then the method 400 proceeds to 412 to flow coolant through the engine block. Thus, hotter coolant from the cylinder head may be mixed with cooler coolant from the block in a coolant passage (e.g., return line 250 of FIG. 2) leading to the coolant pump. In this way, hotter coolant may be delivered to the engine block thereby allowing the engine block temperature to increase at a faster rate compared to continuing to stagnate the coolant following the cylinder head coolant reading the threshold coolant temperature.

At 414, the method 400 includes determining if a temperature of the deactivated cylinders is greater than a threshold cylinder temperature, where the threshold cylinder temperature may be based on a lower limit of a desired cylinder operating range (e.g., 185° F.). If the cylinder temperature is not greater than the threshold cylinder temperature, then the method 400 proceeds to 416 to maintain current operating conditions and continues to monitor the cylinder temperature. In this way, the method 400 continues to flow coolant through the engine block and regions of the cylinder head corresponding to the active cylinders while not flowing coolant to the regions of the cylinder head corresponding to the deactivated cylinders.

If the cylinder temperature is greater than the threshold cylinder temperature, then the method 400 proceeds to 418 to flow coolant to regions (first region 217 and third region 219) of the cylinder head corresponding to the deactivated cylinders (first cylinder 210 and fourth cylinder 214) by actuating a first and third region passage valve to an open position. In this way, coolant flows to an entirety of the cylinder head and engine block. By doing this, the deactivated cylinders may reach a desired operating temperature such that a warm-up period of the deactivated cylinders during reactivation is decreased, thereby decreasing emissions.

Returning to 404, if a cold-start is not occurring, then the engine may be operating at the desired temperature and the method 400 proceeds to 420 to determine if any cylinders are deactivated. If cylinders are not deactivated, then the method 400 proceeds to 422 to maintain current engine operating parameters and to flow coolant to all regions of the cylinder head and to flow coolant to the block. If cylinders are deactivated, then the method 400 proceeds to 424 to stagnate coolant in the regions of the head associated with the deactivated cylinders while flowing coolant to the block and regions of the head associated with activated cylinders. As an example, if cylinders 210 and 216 are deactivated while cylinders 212 and 214 are active, then a first and third region outlet valve may be in a closed position while a cylinder head outlet valve may be in an open position. By doing this, the stagnated coolant may maintain a temperature of the deactivated cylinders while even heating/cooling is provided to a remainder of the engine. In some examples, coolant may continue to flow to the regions associated with the deactivated cylinders when the engine is operating within the desired operating temperature range.

In this way, a coolant system may be used to improve warm-up times of an engine by flowing coolant to regions of a cylinder head associated with active cylinders while simultaneously not flowing coolant to remaining regions of the cylinder head associated with deactivated cylinders. Regions of the cylinder head are fluidly sealed from each other such that coolant in the regions associated with active cylinders does not flow into regions associated with deactivate cylinders. The technical effect of flowing coolant to only active cylinders during a cold-start is to reduce an amount of matter being heated during the cold-start. By doing this, warm-up times may be improved and emissions may be reduced. Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

deactivating a first cylinder group of an engine during a cold-start;

independently flowing coolant to an engine block coolant jacket, a first region of a cylinder head coolant jacket, and a second region of the cylinder head coolant jacket, the second region of the cylinder head coolant jacket corresponding to a second, active cylinder groups;

stagnating coolant in the first region of the cylinder head coolant jacket corresponding to the first cylinder group and the engine block coolant jacket; and flowing coolant to each individual cylinder head of the second, active cylinder group through separate paths, and flowing coolant through a crossover path from a coolant passage surrounding one cylinder head of the second, active cylinder group to a coolant passage surrounding another cylinder head of the second, active cylinder group, wherein the second, active cylinder group is located interior to the first cylinder group, and wherein each of the first and second regions of the cylinder head coolant jacket are fluidly sealed from each other and the engine block coolant jacket.

2. The method of claim 1, further comprising stagnating coolant in the engine block coolant jacket located below the cylinder head coolant jacket.

3. The method of claim 2, further comprising flowing coolant through the engine block coolant jacket when a temperature of coolant of the second region of the cylinder head coolant jacket exceeds a first threshold.

4. The method of claim 3, further comprising controlling coolant flow from the cylinder head coolant jacket and the engine block coolant jacket into a return line of a coolant circuit using valves positioned downstream of outlets of coolant jackets of each of the first region of the cylinder head coolant jacket, the second region of the cylinder head coolant jacket, and the cylinder block coolant jacket.

5. The method of claim 1, wherein the crossover path mixes coolant of two individual cylinder heads of the second, active cylinder group before the coolant enters a return line and coolant flows through the second region of the cylinder head coolant jacket when coolant in one or both of the first region of the cylinder head coolant jacket and the engine block coolant jacket is stagnated.

6. The method of claim 1, further comprising flowing coolant to the first region of the cylinder head coolant jacket when a temperature of the first cylinder group.

7. The method of claim 1, further comprising stagnating coolant flow in the first region of the cylinder head coolant jacket and flowing coolant to the engine block coolant jacket in response to deactivating the first cylinder group.

8. The method of claim 1, wherein coolant flows directly between two cylinder heads of the second, active cylinder group via the crossover path and the crossover path is not directly connected to a supply or discharge line, and further comprising flowing warmed coolant from the second region of the cylinder head coolant jacket into the first region of the cylinder head coolant jacket before activating the first cylinder group.

9. A system comprising:

an engine having a cylinder head and an engine block, where the cylinder head is physically coupled to a top of the engine block;

the cylinder head and the engine block comprising a head coolant jacket and a block coolant jacket, respectively, and where the jackets are fluidly separated from one another within the engine;

the head coolant jacket comprising two outer regions positioned above pistons configured to be deactivated and one central region positioned above active cylinders where the two outer regions and one central region are hermetically sealed from each other and the block coolant jacket;

the one central region including a crossover path extending from a passage surrounding one cylinder head of the central region to a passage surrounding another cylinder head of the central region;

valves in the head coolant jacket and the block coolant jacket positioned to stagnate coolant flow in the engine block, stagnate coolant flow in the two outer regions, and stagnate coolant flow in the engine block and the two outer regions, and a coolant circuit comprising a coolant pump fluidly coupled to the head coolant jacket and the block coolant jacket.

10. The system of claim 9, wherein one of the valves is located on a coolant circuit branch comprising only the two outer regions, one of the valves is located on a coolant circuit branch comprising the central region and the two outer regions, and one of the valves is located on a coolant circuit branch comprising only the engine block.

11. The system of claim 10, wherein the valves independently control coolant flow from each of the two outer regions, the central region, and the block coolant jacket into a return line.

12. The system of claim 10, wherein two of the valves are located between an outlet of the two outer regions and a return line and between an outlet of the block coolant jacket and the return line.

13. The system of claim 9, wherein one of the valves is positioned in a coolant path between a junction of outlets of the two outer regions and a junction of the outer regions and a central region outlet, one of the valves is positioned in a coolant path between a junction of inlets of the two outer regions and a junction of the outer regions and a central region inlet, one of the valves is positioned in a coolant path between a junction of the outer regions and the central region and a junction of the head coolant jacket and the block coolant jacket, and one of the valves is positioned between an engine block outlet and the junction of the head coolant jacket and the block coolant jacket.

14. A method for operating a combustion engine having a split cooling system, comprising:

flowing coolant to an engine block having an engine block coolant jacket and a separate cylinder head having a cylinder head coolant jacket, independently flowing coolant into each of two separate subregions within the cylinder head coolant jacket and the engine block coolant jacket, each subregion sealed from the other subregion and the engine block coolant jacket, stagnating coolant flow through one of the subregions of the cylinder head coolant jacket of one or more deactivated cylinders and the engine block coolant jacket while flowing coolant to one of the subregions of the cylinder head coolant jacket of active cylinders in response to a cold-start, flowing coolant through the engine block coolant jacket in response to a first temperature exceeding a first threshold, and flowing coolant through the subregion of the cylinder head coolant jacket of the one or more deactivated cylinders and maintaining flow through the engine block coolant jacket in response to a second temperature exceeding a second threshold.

15. The method of claim 14, further including flowing coolant which has already been warmed by the subregion of the cylinder head coolant jacket of the active cylinders through the subregion of the cylinder head coolant jacket of the one or more deactivated cylinders in response to a request to activate the one or more deactivated cylinders.

16. The method of claim 15, further comprising flowing coolant through all of the subregions of the cylinder head coolant jacket in response to the request to activate the one or more deactivated cylinders.

17. The method of claim 16, further comprising flowing coolant through the engine block coolant jacket in response to the request to activate the one or more deactivated cylinders.

18. The method of claim 14, further comprising:

stagnating coolant flow to the subregion of the cylinder head coolant jacket of the one or more deactivated cylinders while maintaining coolant flow to the engine block coolant jacket and the subregion of the cylinder head coolant of the active cylinders in response to a request to deactivate cylinders; and flowing coolant to the subregion of the cylinder head coolant jacket of the one or more deactivated cylinders when a temperature exceeds a third threshold.

19. The method of claim 14, wherein the coolant flowed through the engine block coolant jacket in response to the first temperature exceeding the first threshold has been warmed in the subregion of the cylinder head coolant jacket of the active cylinders, and wherein coolant flowed to the subregion of the cylinder head coolant jacket of the one or more deactivated cylinders remains stagnated in response to the first temperature exceeding the first threshold.

20. The method of claim 14, wherein the subregion of the cylinder head coolant jacket of the active cylinders is interior to the subregion of the cylinder head coolant jacket of the one or more deactivated cylinders, and wherein the subregion of the cylinder head coolant jacket of the active cylinders includes a coolant passage between individual heads of the active cylinders.

* * * * *